US007229290B1

(12) United States Patent
Chang et al.

(10) Patent No.: US 7,229,290 B1
(45) Date of Patent: Jun. 12, 2007

(54) INTERFACE CARD WITH A MECHANISM FOR COVERING A CONNECTOR THEREOF

(75) Inventors: Lung-Chiao Chang, Taipei Hsien (TW); Shun-Fa Yu, Taipei Hsien (TW); Kuan-Hsun Lu, Taipei Hsien (TW); Chia-Hung Chen, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 0 days.

(21) Appl. No.: 11/532,537

(22) Filed: Sep. 17, 2006

Related U.S. Application Data

(62) Division of application No. 11/308,007, filed on Mar. 2, 2006, now Pat. No. 7,147,476.

(30) Foreign Application Priority Data

Dec. 1, 2005 (TW) ..... 94220903

(51) Int. Cl.
*H01R 12/00* (2006.01)

(52) U.S. Cl. ..... 439/62; 439/38

(58) Field of Classification Search ..... 439/62, 439/38, 79, 149, 607–609, 630
See application file for complete search history.

(56) References Cited

U.S. PATENT DOCUMENTS

| | | | | |
|---|---|---|---|---|
| 4,443,049 | A * | 4/1984 | De Pommery et al. | 439/373 |
| 5,133,679 | A | 7/1992 | Fusselman et al. | |
| 5,338,227 | A | 8/1994 | Nakamura | |
| 6,431,915 | B1 | 8/2002 | Ko | |
| 6,506,078 | B1 | 1/2003 | Mori et al. | |
| 6,527,587 | B1 | 3/2003 | Ortega et al. | |
| 6,572,410 | B1 | 6/2003 | Volstorf et al. | |

* cited by examiner

*Primary Examiner*—Khiem Nguyen
(74) *Attorney, Agent, or Firm*—Winston Hsu

(57) ABSTRACT

An interface card includes a circuit board including an opening, a connector installed on an edge of the circuit board, a covering means including a first shield installed on a side of the circuit board and including a hole, and a second shield installed on the other side of the circuit board including a pin for passing through the opening of the circuit board and inserting into the hole of the first shield so as to combine the second shield with the first shield for covering the connector.

12 Claims, 10 Drawing Sheets

INTERFACE CARD WITH A MECHANISM FOR COVERING A CONNECTOR THEREOF

CROSS REFERENCE TO RELATED APPLICATIONS

This application is a division of U.S. application Ser. No. 11/308,007 filed Mar. 2, 2006, now U.S. Pat. No. 7,147,476, the contents of which are hereby incorporated by reference.

BACKGROUND OF THE INVENTION

1. Field of the Invention

The present invention relates to an interface card, and more particularly, to an interface card with a mechanism for covering a connector thereof.

2. Description of the Prior Art

Please refer to FIG. 1. FIG. 1 is a diagram of an interface card 10 seated on a motherboard 12 of the prior art. The motherboard 12 includes a plurality of slots 14 which can each conform to peripheral component interface-express (PCI-E), peripheral component interface (PCI), and so on. The interface cards 10 can be inserted into one of the slots 14. An interface card 10 can be a sound card, a SCSI card, a network card, and so on.

Please refer to FIG. 1 and FIG. 2. FIG. 2 is diagram of the interface card 10 shown in FIG. 1 of the prior art. The interface card 10 includes a circuit board 16 which can be a printed circuit board and a bracket 18 connected to the circuit board 16 for wedging into an opening of a case (not shown in figures). The bracket 18 can be an L-shaped bracket. The interface card 10 further includes a connector 20 installed on an edge of the circuit board 16 for inserting into the slot 14 of the motherboard 12. The connector 20 includes a plurality of golden fingers, and the connector 20 can conform to PCI-E, PCI, accelerated graphics port (AGP) interface, and so on. The interface of the connector 20 needs to match the interface of the slot 14.

Because the connector 20 is an electrical interface for data transmission between the interface card 10 and the motherboard 12, there is a need to keep the connector 20 clean to avoid poor electrical connection between the interface card 10 and the motherboard 12. However when the interface card 10 is not inserted into the slot 14, the connector 20 of the interface card 10 is typically exposed to the air so that the connector 20 can be easily covered with dust or oxidized. Even when the interface card 10 is inserted into the slot 14, dust can still fall onto the interface of the connector 20 and the slot 14 resulting in poor electrical contact between the interface card 10 and the motherboard 12.

SUMMARY OF THE INVENTION

It is therefore a primary objective of the claimed invention to provide an interface card with a mechanism for covering a connector thereof for solving the above-mentioned problem.

According to the claimed invention, an interface card includes a circuit board including an opening, a connector installed on an edge of the circuit board, a covering means including a first shield installed on a side of the circuit board and including a hole, and a second shield installed on the other side of the circuit board including a pin for passing through the opening of the circuit board and inserting into the hole of the first shield so as to combine the second shield with the first shield for covering the connector.

According to the claimed invention, an interface card includes a circuit board including an opening, a connector installed on an edge of the circuit board, and a covering means. The covering means includes a first shield installed on a side of the circuit board, a second shield installed on another side of the circuit board, and two magnetic spacers installed on the first shield and the second shield so as to combine the second shield with the first shield for covering the connector.

According to the claimed invention, a covering means for covering a connector of an interface card includes a first shield connected to a side of the interface card. The first shield includes a groove. The covering means further includes a second shield connected to another side of the interface card. The second shield includes a groove. The covering means further includes two cushions installed inside the groove of the first shield and the groove of the second shield, and two magnetic spacers installed on the first shield and the second shield so as to combine the second shield with the first shield for covering the connector.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
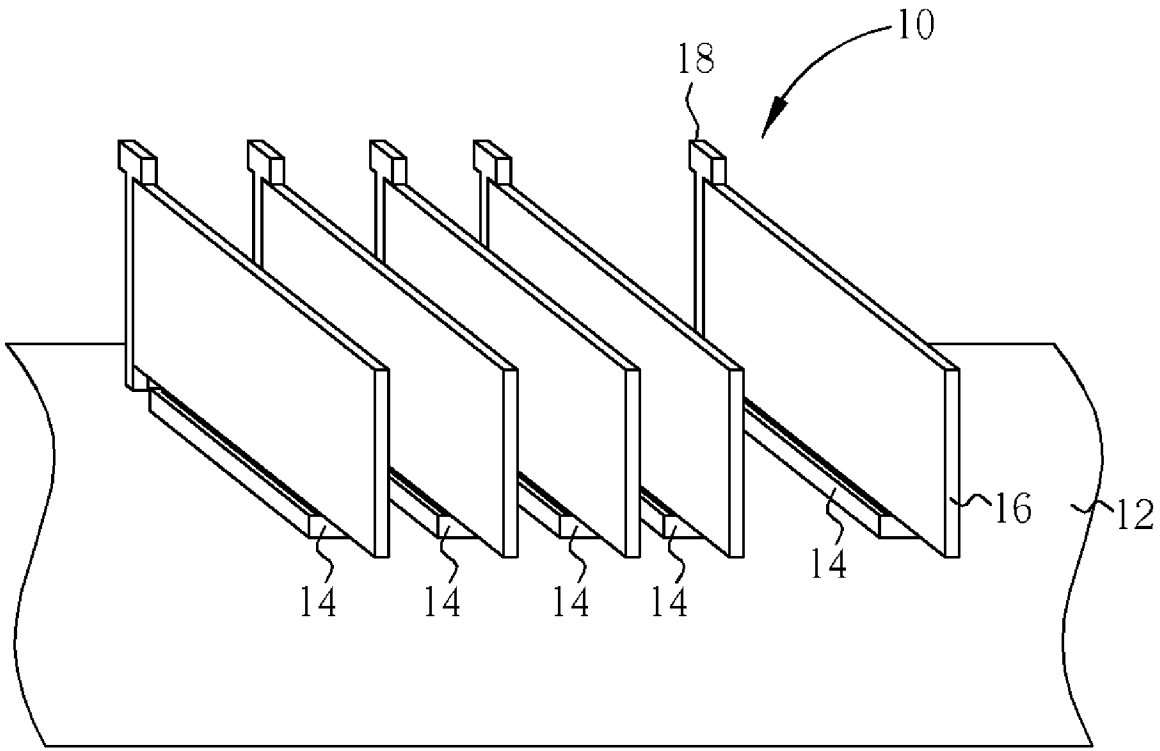
Fig. 1 Prior Art
FIG. 1 is a diagram of an interface card inserted into a motherboard according to the prior art.
Figure 2:
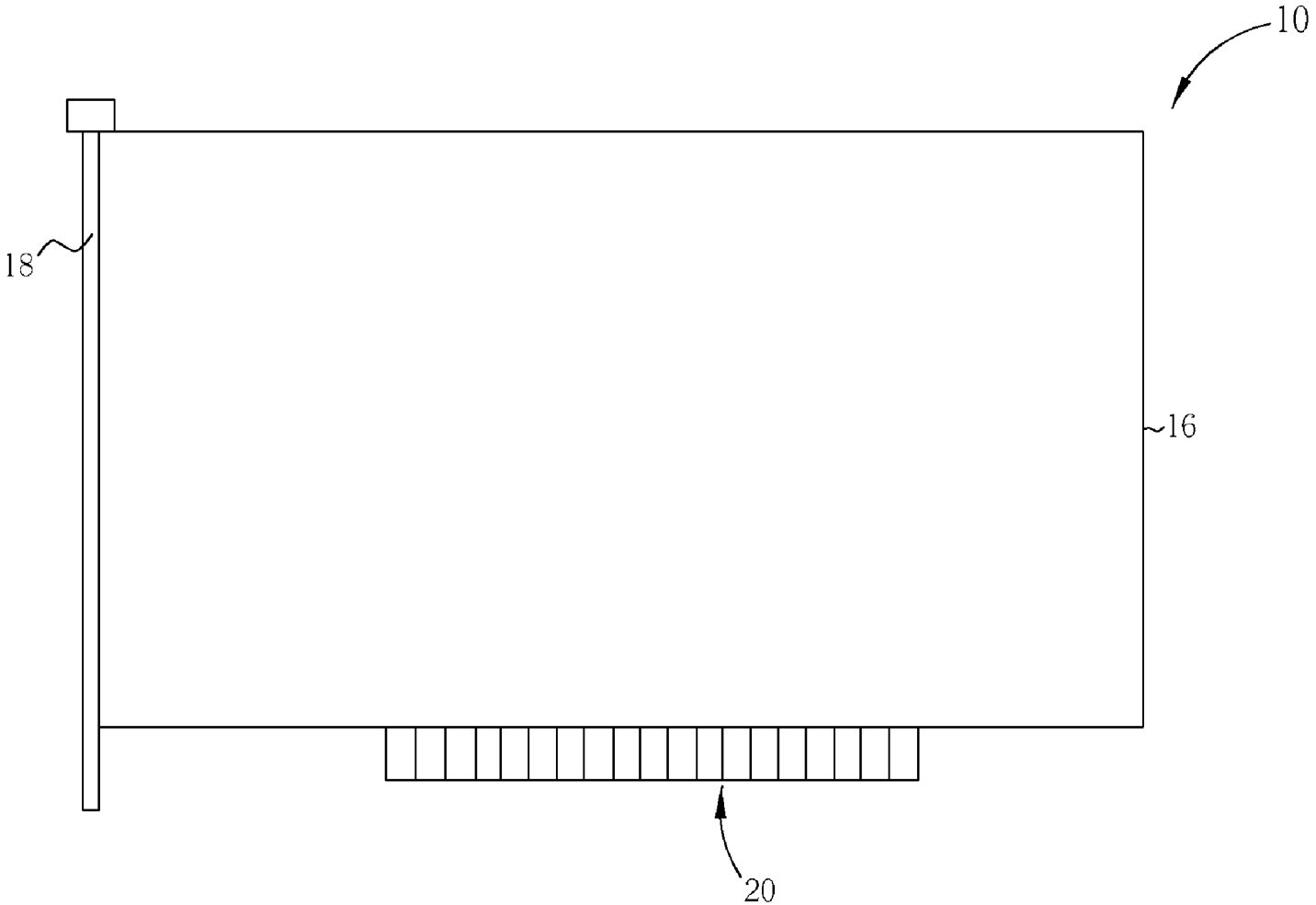
Fig. 2 Prior Art
FIG. 2 is diagram of the interface card shown in FIG. 1.
Figure 3:
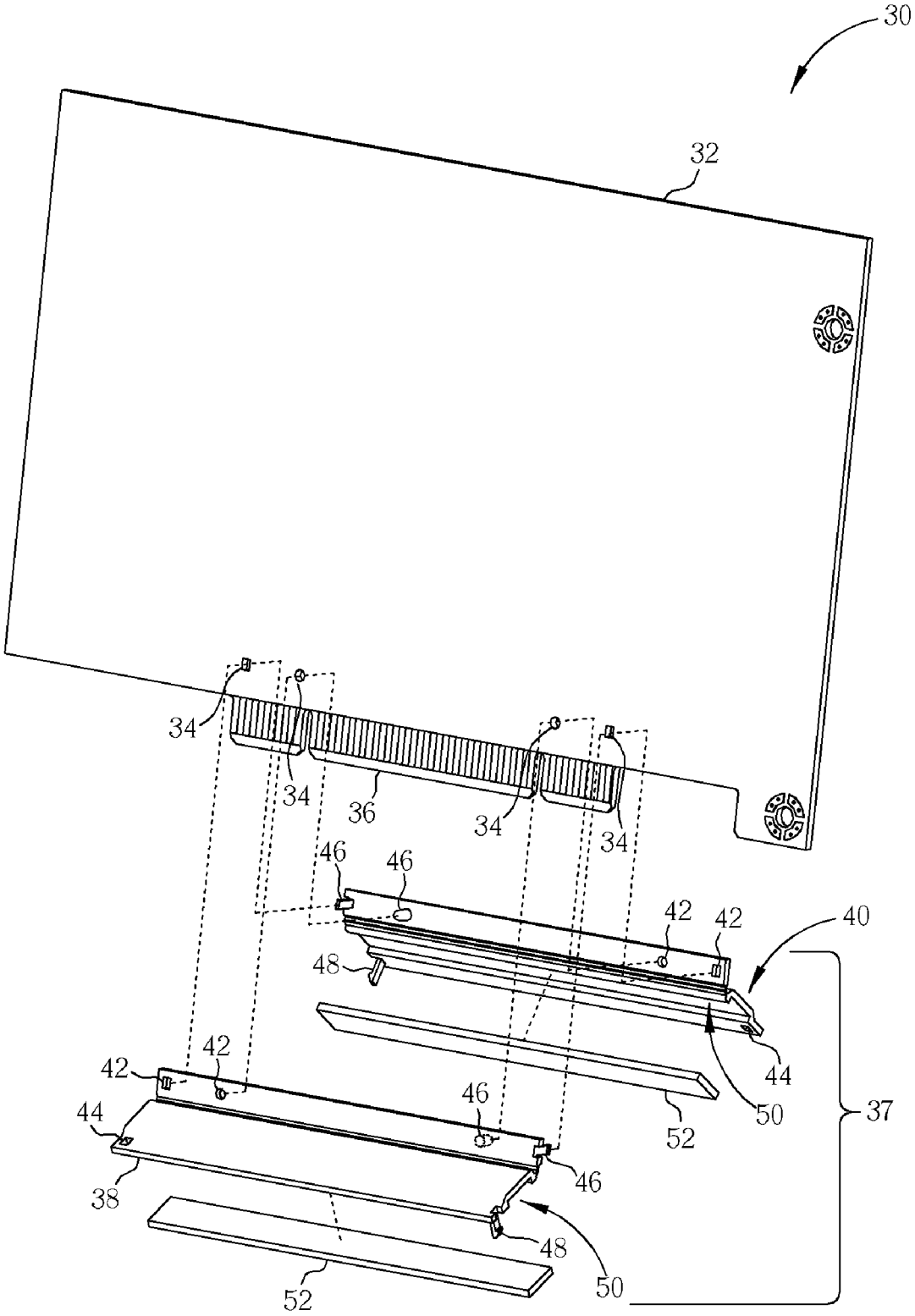
FIG. 3 is an exploded diagram of an interface card according to a first embodiment of the present invention.

Please refer to FIG. 3. FIG. 3 is an exploded diagram of an interface card 30 according to a first embodiment of the present invention. The interface card 30 can be a sound card, a SCSI card, a network card, a memory card, and so on. The interface card 30 includes a circuit board 32 which can be a printed circuit board. At least one opening 34 is positioned on the circuit board 32. The interface card 30 further includes a connector 36 installed on an edge of the circuit board 32. The connector 36 includes a plurality of golden fingers, and the connector 36 can conform to PCI-E, PCI, AGP, and so on. The interface card 30 further includes a covering means 37. The covering means 37 includes a first shield 38 installed on a side of the circuit board 32 and a second shield 40 installed on the other side of the circuit board 32 for combining with the first shield 38 so as to cover the connector 36. The first shield 38 and the second shield 40 can be made of polyethylene (PE) or polypropylene (PP) and can be one-piece moldings. The first shield 38 includes two first holes 42, a second hole 44, two first pins 46, and a second pin 48. The second shield 40 also includes two first holes 42, a second hole 44, two first pins 46, and a second pin 48. The first pin 46 is capable of passing through the opening 34 of the circuit board 32 and inserting into the first hole 42 of the other shield. The second pin 48 is capable of inserting into the second hole 44 of the other shield when the first shield 38 and the second shield 40 are closed. In addition, two grooves 50 are formed on the first shield 38 and the second shield 40, one grove on each shield. Cushions 52 are installed inside the groove 50 of the first shield 38 and the groove 50 of the second shield 40. The two cushions 52 can be attached to the groove 50 of the first shield 38 and the groove 50 of the second shield 40. Each cushion 52 can be a deformable component which can be made of rubber or foam (i.e., PORON, EPDM) so as to avoid crushing the connector 36 when the cushions 52 contact with the connector 36 with the combination of the first shield 38 and the second shield 40.

Figure 4:
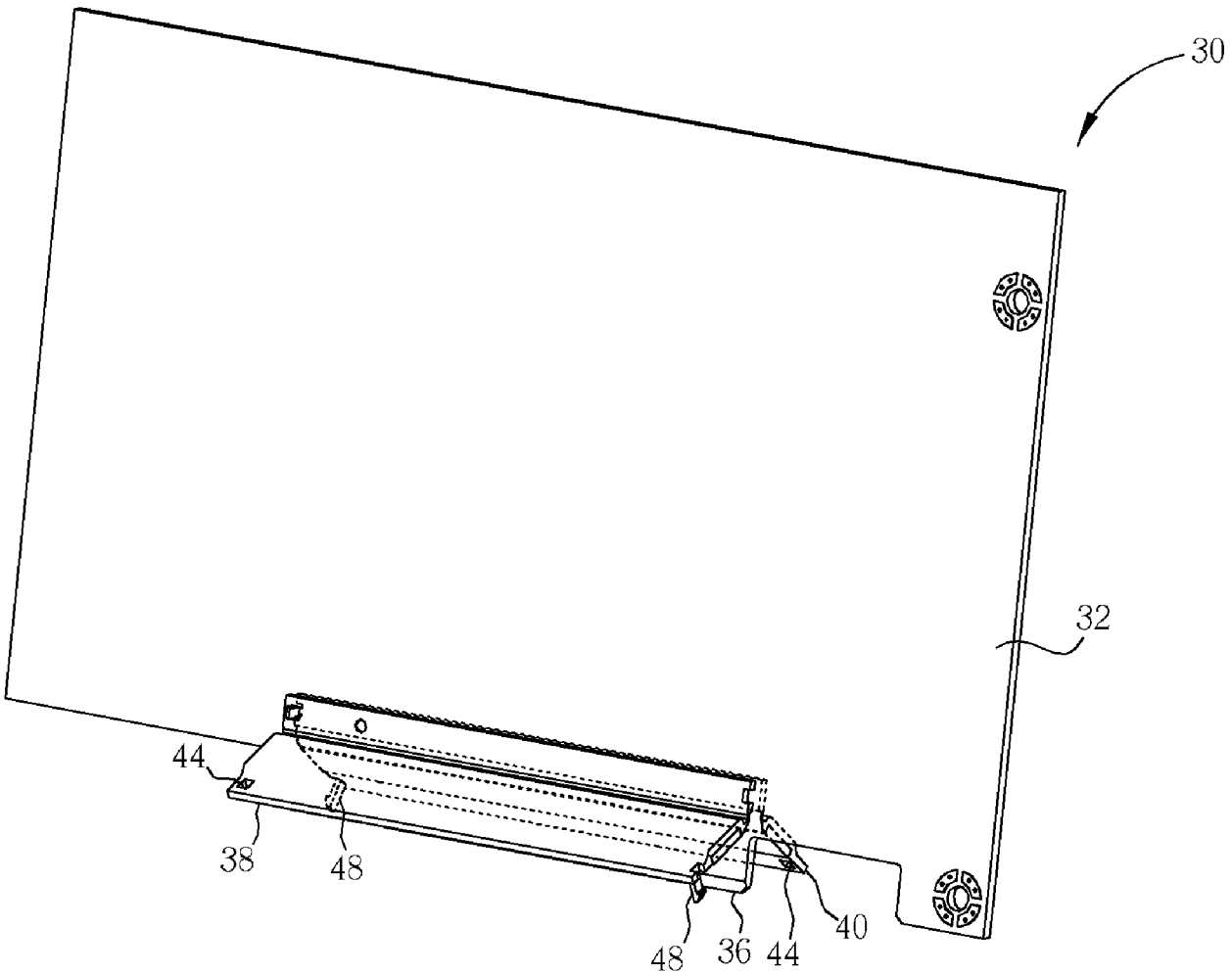
FIG. 4 is a diagram of the interface card when a first shield and a second shield are not closed according to the first embodiment of the present invention.
Figure 5:
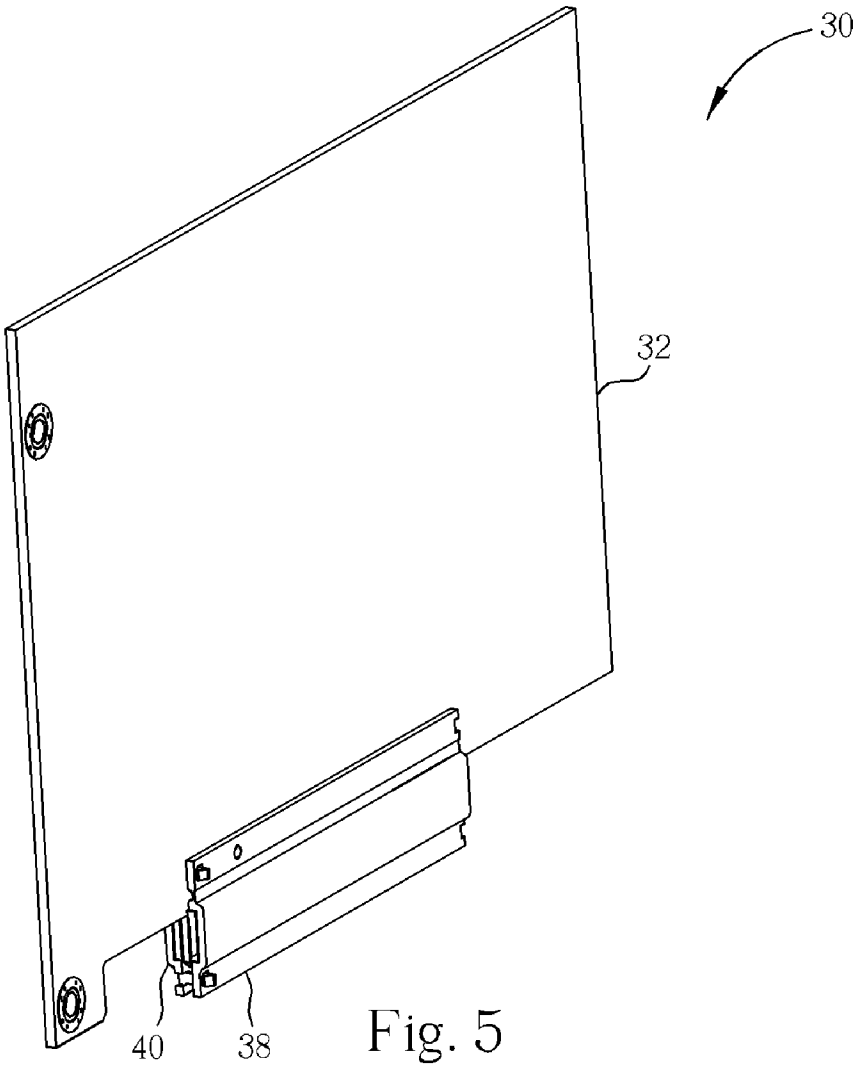
FIG. 5 is a diagram of the interface card when the first shield and the second shield are closed according to the first embodiment of the present invention.

Please refer to FIG. 3, FIG. 4, and FIG. 5. FIG. 4 is a diagram of the interface card 30 when the first shield 38 and the second shield 40 are not closed according to the first embodiment of the present invention. FIG. 5 is a diagram of the interface card 30 when the first shield 38 and the second shield 40 are closed respectively the first embodiment of the present invention. When the interface card 30 is not utilized, the second pin 48 of the first shield 38 can be inserted into the second hole 44 of the second shield 40 and the second pin 48 of the second shield 40 can be inserted into the second hole 44 of the first shield 38 so as to combine the first shield 38 with the second shield 40. The first shield 38 and the second shield 40 can cover the connector 36 of the interface card 30 instead of allowing the connector 36 to be exposed to air so as to prevent dust from gathering on the connector 36 or to prevent the connector 36 from being oxidized. The connector 36 contacts with the cushions and will not be crushed.

Figure 6:
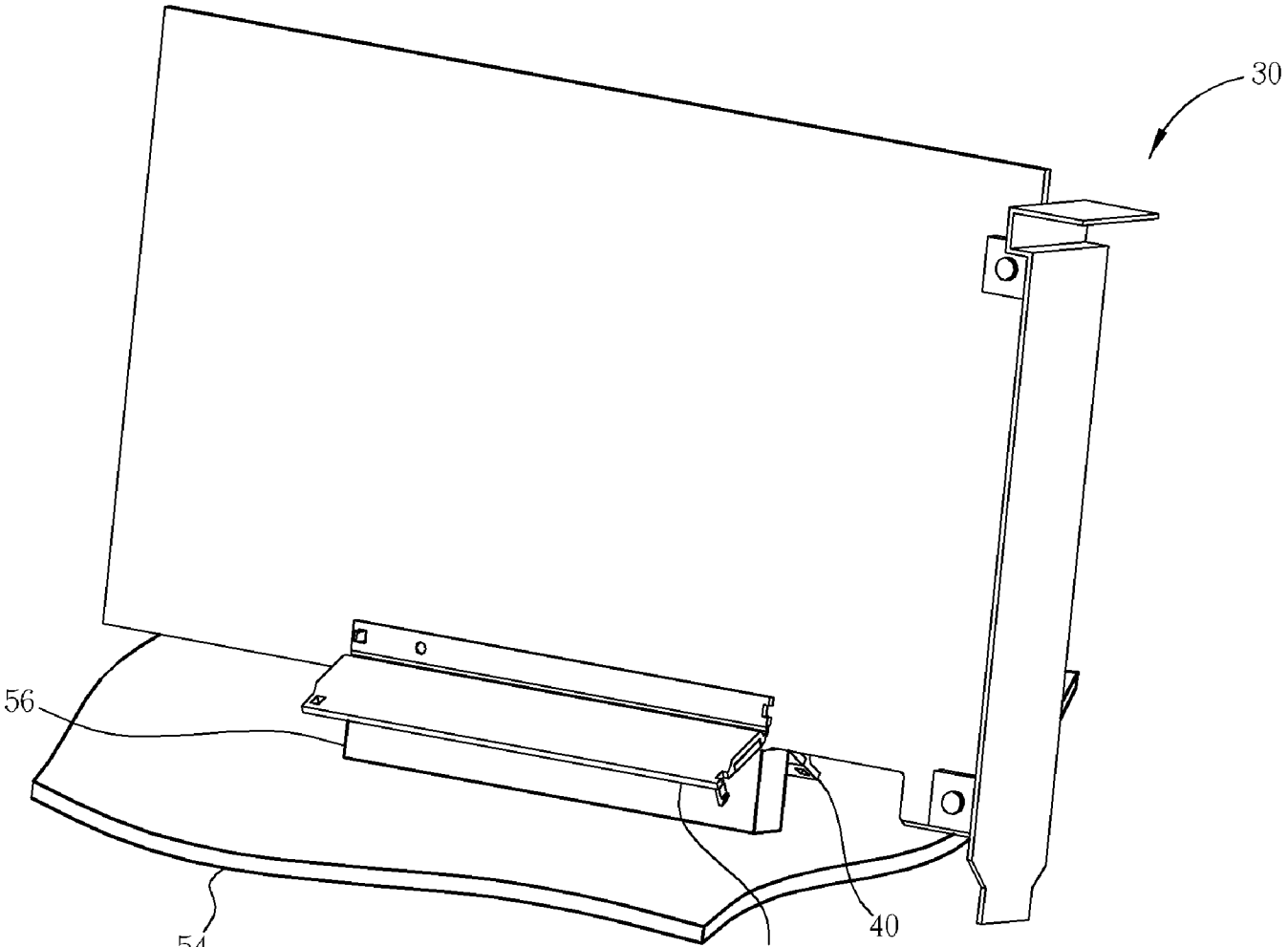
FIG. 6 is a diagram of the interface card inserted into a motherboard according to the first embodiment of the present invention.

Please refer to FIG. 6. FIG. 6 is a diagram of the interface card 30 inserted into a motherboard 54 according to the first embodiment of the present invention. The motherboard 54 includes a plurality of slots 56 which can conform to PCI-E, PCI, and so on. The interface card 30 can be inserted into one of the slots 56. The interface of the connector 36 of the interface card 30 needs to match the interface of the slot 56. When the interface card 30 is inserted into the slot 56, the first shield 38 and the second shield 40 are opened so as to cover the joint of the connector 36 of the interface card 30 and the slot 56. This can prevent dust from collecting on the joint of the connector 36 and the slot 56 keeping the electrical connection between the interface card 30 and the motherboard 54 clean.

Figure 7:
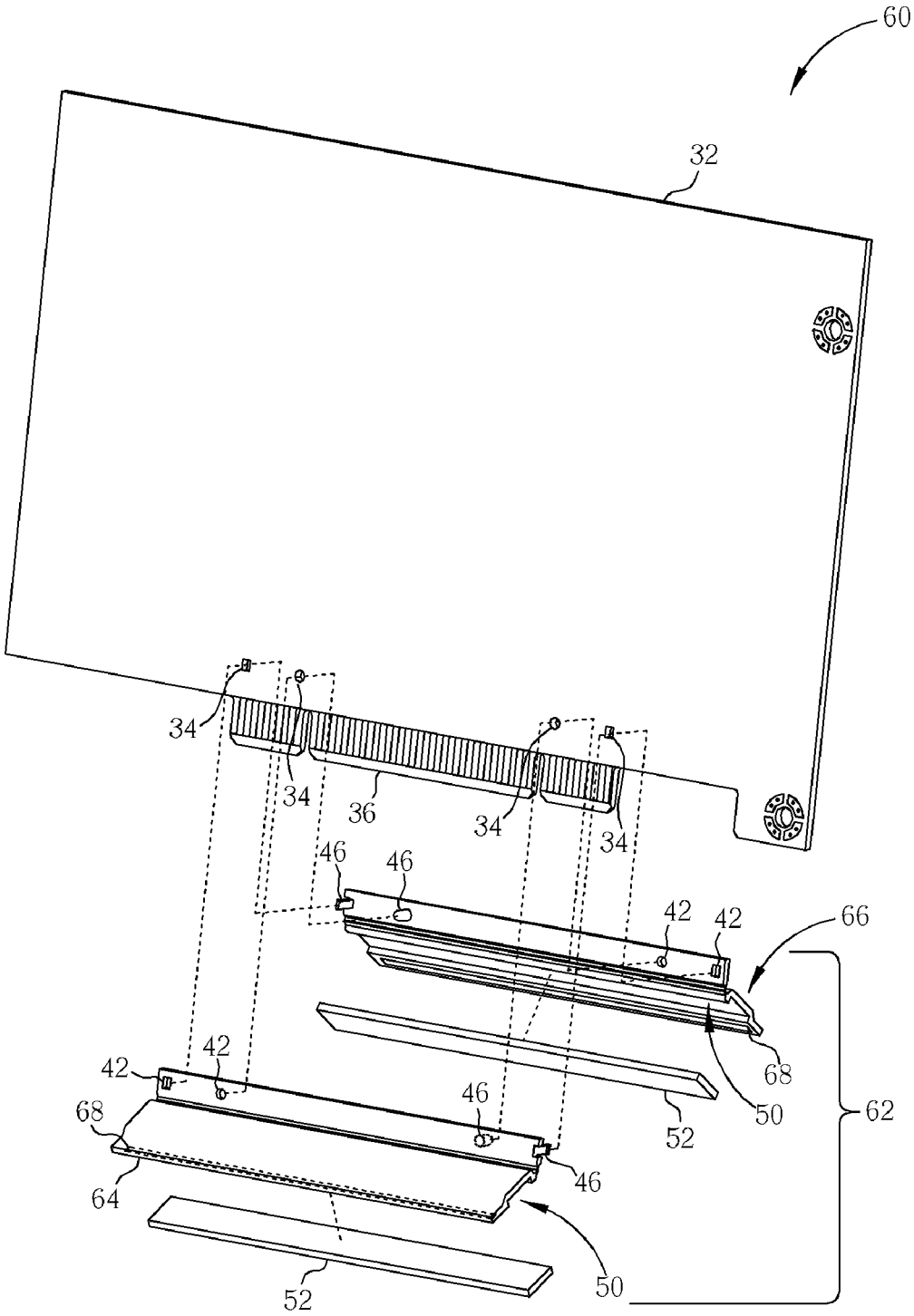
FIG. 7 is an exploded diagram of an interface card according to a second embodiment of the present invention.

Please refer to FIG. 7. FIG. 7 is an exploded diagram of an interface card 60 according to a second embodiment of the present invention. The difference between the interface card 30 of the first embodiment and the interface card 60 of the second embodiment is that the interface card 60 utilizes magnetic spacers as a mechanism for combining the two shields instead of utilizing pins and holes as a mechanism for combining the two shields of the interface card 30. The interface card 60 also includes the circuit board 32 and the connector 36 installed on a side of the circuit board 32. The interface card 60 further includes a covering means 62. The covering means 62 includes a first shield 64 installed on a side of the circuit board 32 and a second shield 66 installed on the other side of the circuit board 32 for combining with the first shield 64 so as to cover the connector 36. Two magnetic spacers 68 are installed on the bottom of the first shield 64 and on the bottom of the second shield 66 respectively so as to provide magnetic force for combining the second shield 66 with the first shield 64 tightly. In addition, the first shield 64 includes the first holes 42 and the first pins 46 on the top of the first shield 64, and the second shield 66 includes the first holes 42 and the first pins 46 on the top of the second shield 66. The first pins 46 are capable of passing through the openings 34 of the circuit board 32 and inserting into the first holes 42 of the other shield. The grooves 50 are formed on the first shield 64 and the second shield 66. The cushions 52 are installed inside the groove 50 of the first shield 64 and the groove 50 of the second shield 66. The cushions 52 can be attached to the groove 50 of the first shield 38 and the groove 50 of the second shield 40. Each cushion 52 can be a deformable component which can be made of rubber or foam (i.e., PORON, EPDM) so as to avoid crushing the connector 36 when the cushions 52 contact with the connector 36 with the combination of the first shield 64 and the second shield 66.

Figure 8:
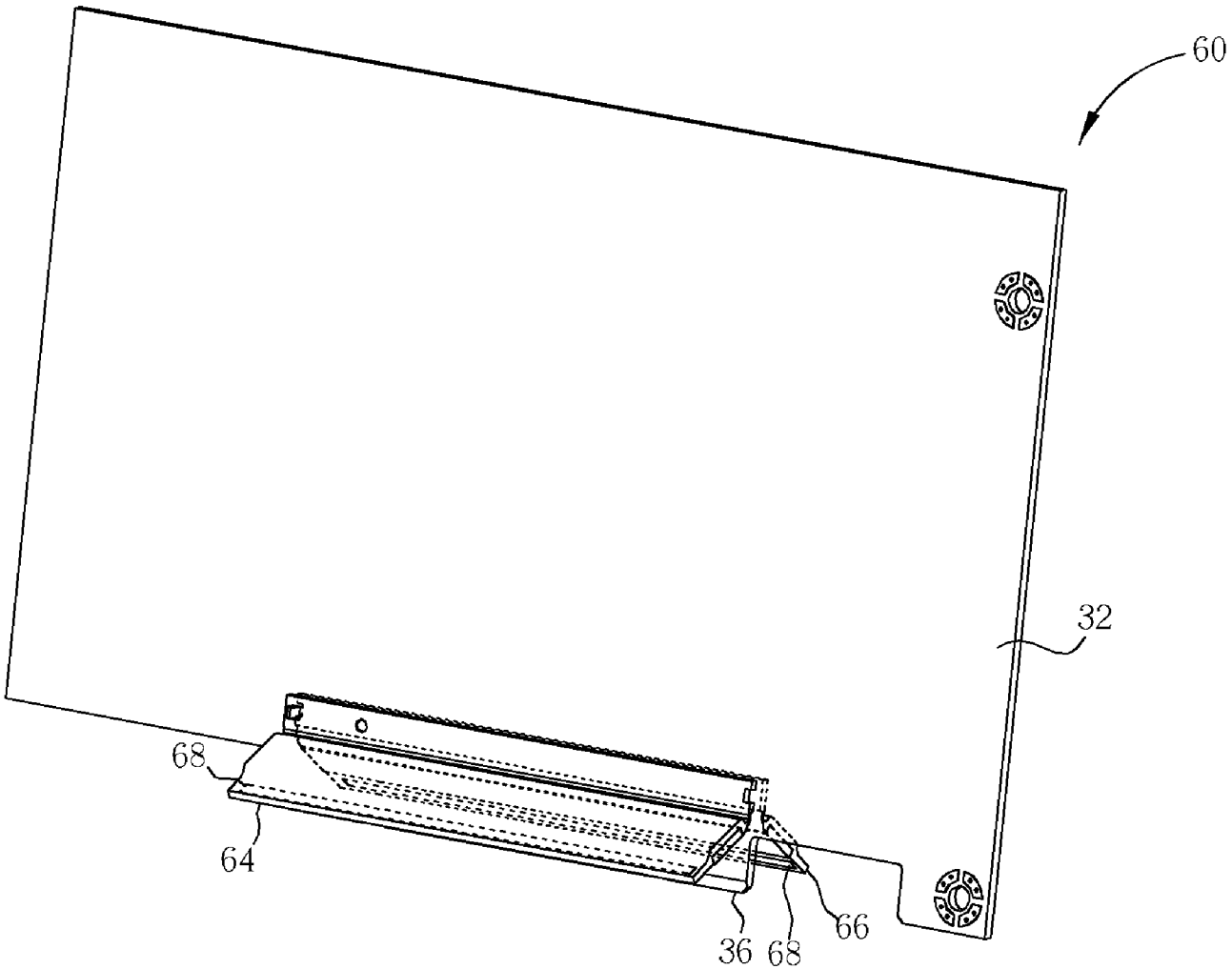
FIG. 8 is a diagram of the interface card when a first shield and a second shield are not closed according to the second embodiment of the present invention.
Figure 9:
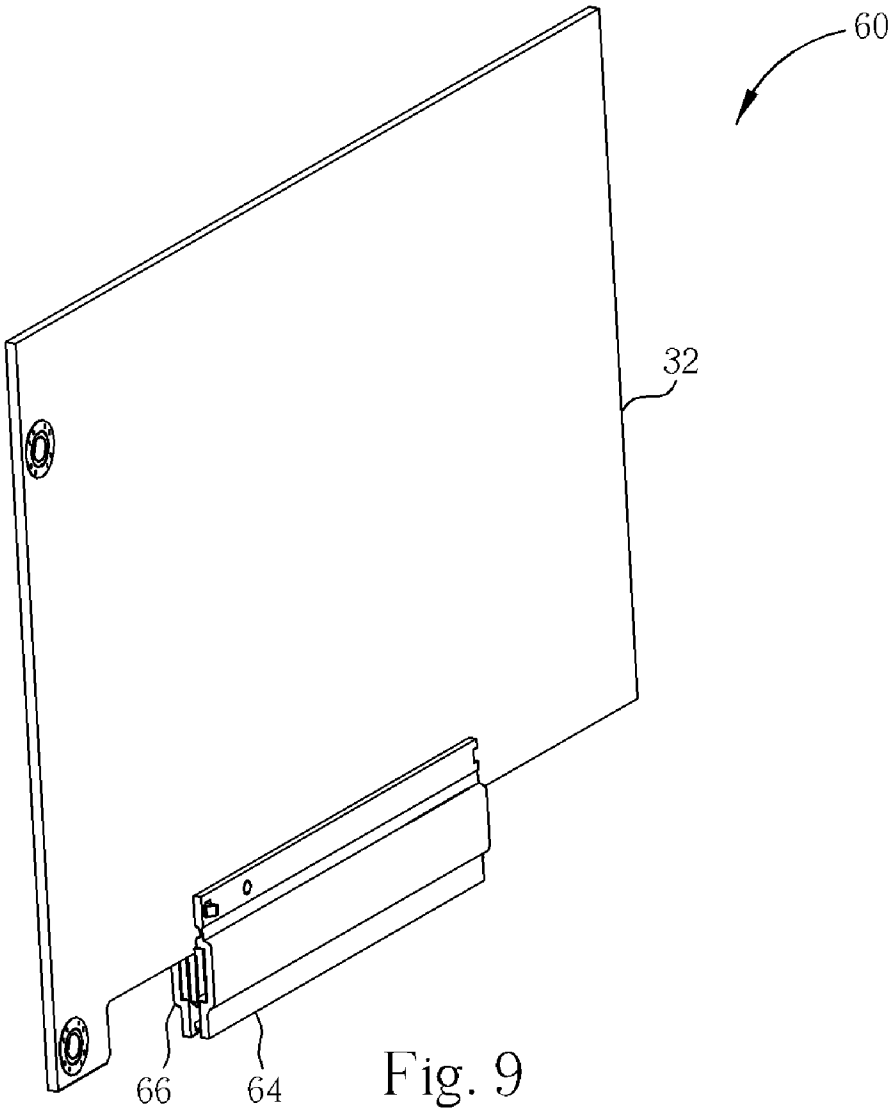
FIG. 9 is a diagram of the interface card when the first shield and the second shield are closed according to the second embodiment of the present invention.

Please refer to FIG. 7, FIG. 8, and FIG. 9. FIG. 8 is a diagram of the interface card 60 when the first shield 64 and the second shield 66 are not closed according to the second embodiment of the present invention. FIG. 9 is a diagram of the interface card 60 when the first shield 64 and the second shield 66 are closed according to the second embodiment of the present invention. When the interface card 60 is not utilized, the magnetic spacer 68 on the first shield 64 and the magnetic spacer 68 on the second shield 66 attract each other so as to combine the first shield 64 with the second shield 66. The first shield 64 and the second shield 66 can cover the connector 36 of the interface card 60 instead of leaving the connector 36 exposed to air so as to prevent dust from collecting on the connector 36 or to prevent the connector 36 from being oxidized.

Figure 10:
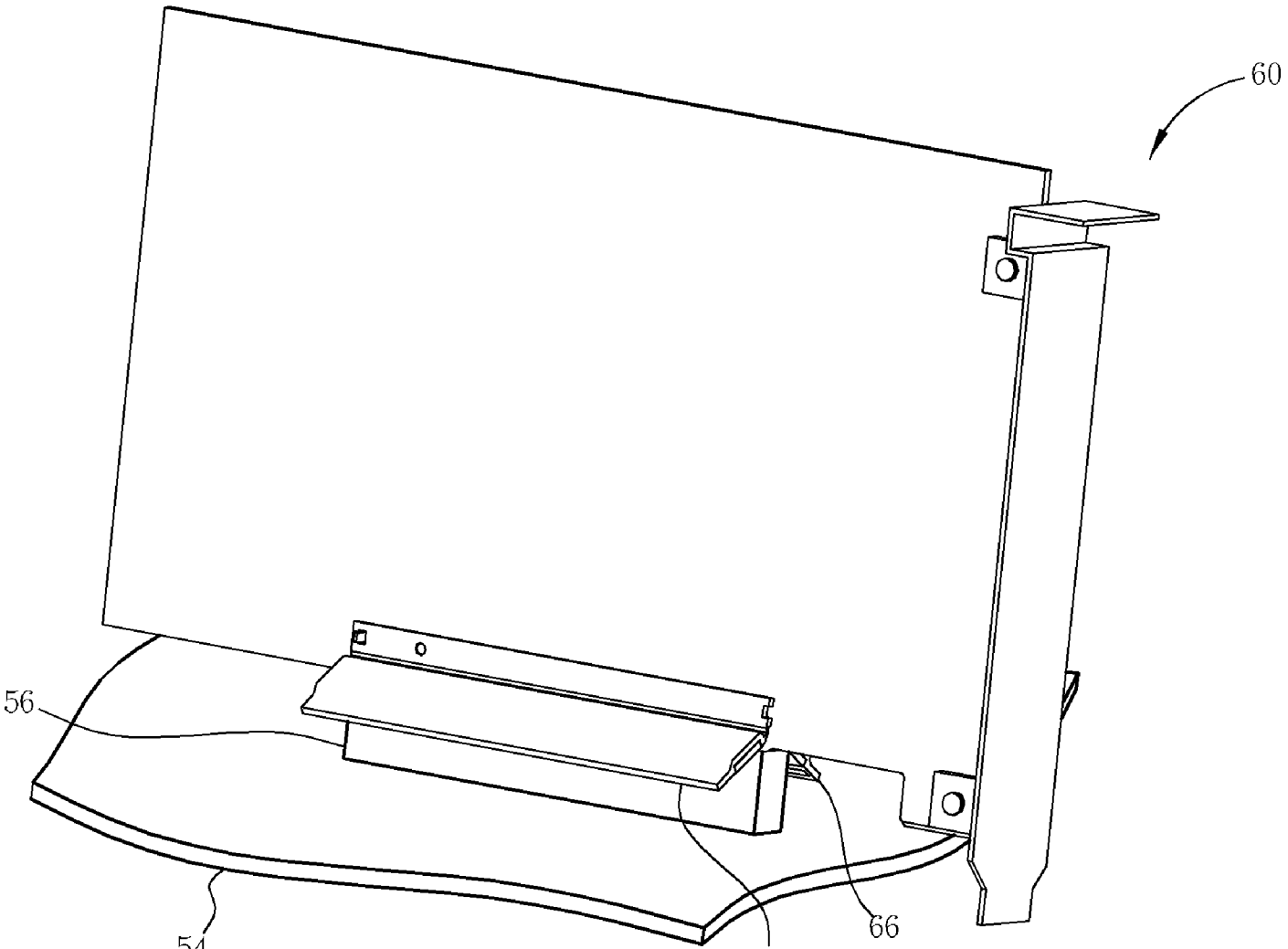
FIG. 10 is a diagram of the interface card inserted into the motherboard according to the second embodiment of the present invention.

Please refer to FIG. 10. FIG. 10 is a diagram of the interface card 60 inserted into the motherboard 54 of the second embodiment according to the present invention. The motherboard 54 includes the plurality of slots 56. When the interface card 60 is inserted into the slot 56, the first shield 64 and the second shield 66 are open so as to cover the joint of the connector 36 of the interface card 60 and the slot 56. This can prevent dust from gathering on the joint of the connector 36 and the slot 56 keeping the electrical connection between the interface card 60 and the motherboard 54 clean.

In contrast with the conventional interface card, the interface card according to the present invention utilizes two shields to cover the connector. When the interface card is not utilized, the connector can be protected by the shields. When the interface card is inserted into a slot of a motherboard, the shields can open so as to cover the joint of the connector of the interface card and the slot. This can prevent dust from gathering on the joint of the connector and the slot thereby keeping the electrical connection between the interface card and the motherboard clean.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. An interface card comprising:

a circuit board comprising an opening;

a connector installed on an edge of the circuit board; and a covering means comprising:

a first shield installed on a side of the circuit board;

a second shield installed on another side of the circuit board; and two magnetic spacers, one installed on the first shield and the other installed on the second shield so as to combine the second shield with the first shield for covering the connector.

2. The interface card of claim 1 wherein the circuit board is a printed circuit board.

3. The interface card of claim 1 further comprising two cushions, one installed inside a groove of the first shield and the other installed inside a groove of the second shield.

4. The interface card of claim 3 wherein the cushions are made of rubber.

5. The interface card of claim 3 wherein the cushions are made of foam.

6. The interface card of claim 3 wherein each cushion is attached to the respective shield.

7. The interface card of claim 1 wherein the first shield and the second shield are made of polyethylene or polypropylene.

8. A covering means for covering a connector of an interface card comprising:

a first shield connected to a side of the interface card, the first shield comprising a groove;

a second shield connected to another side of the interface card, the second shield comprising a groove;

two cushions, one installed inside the groove of the first shield and the other installed inside the groove of the second shield; and two magnetic spacers, one installed on the first shield and the other installed on the second shield so as to combine the second shield with the first shield for covering the connector.

9. The covering means of claim 8 wherein the cushions are made of rubber.

10. The covering means of claim 8 wherein the cushions are made of foam.

11. The covering means of claim 8 wherein the first shield and the second shield are made of polyethylene or polypropylene.

12. The covering means of claim 8 wherein the first shield is one-piece molding and the second shield is one-piece molding.

* * * * *